US006589123B2

(12) United States Patent
Schmitt

(10) Patent No.: US 6,589,123 B2
(45) **Date of Patent: *Jul. 8, 2003**

(54) GOLF BALL RETRIEVAL APPARATUS

(76) Inventor: Robert Schmitt, 7080 Lillian Ct., Stuart, FL (US) 34997

( * ) Notice: Subject to any disclaimer, the term of this patent is extended or adjusted under 35 U.S.C. 154(b) by 0 days.

This patent is subject to a terminal disclaimer.

(21) Appl. No.: 09/939,549

(22) Filed: Aug. 27, 2001

(65) Prior Publication Data

US 2002/0155897 A1 Oct. 24, 2002

Related U.S. Application Data

(60) Provisional application No. 60/285,694, filed on Apr. 23, 2001.

(51) Int. Cl.[7] ..... A63B 53/00
(52) U.S. Cl. ..... 473/286; 294/19.2
(58) Field of Search ..... 473/286; 294/19.2

(56) References Cited

U.S. PATENT DOCUMENTS 802,264 A * 10/1905 Brown
1,175,035 A * 3/1916 Wooster
1,658,145 A * 2/1928 Uyei
3,318,628 A * 5/1967 White
3,698,720 A * 10/1972 Gudmundsen
4,687,204 A * 8/1987 Lempio
5,004,240 A * 4/1991 Tsukamoto
6,171,202 B1 * 1/2001 Schmitt

* cited by examiner

*Primary Examiner*—Stephen Blau
(74) *Attorney, Agent, or Firm*—Kevin Redmond

(57) ABSTRACT

A golf ball retrieval apparatus comprising a shaft containing a hollow portion with an opening to the hollow portion at one end of the shaft, and a first plug located in the hollow portion of the shaft capable of moving longitudinally within the hollow portion and having holes on a side facing the opening in the shaft. The retrieval apparatus further comprising a plurality of wires with a first end anchored in said holes in said first plug, and a second end with plastic sleeves attached, the second end of the wires being oriented in a conical array. The wires may be placed in a first position which exposes the wires outside the shaft by less than fifty percent of their length and also in a second position which exposes the wires by more than fifty percent of their length outside the shaft. A second plug is fixedly located in the hollow portion of the shaft to prevent the first plug and wires from penetrating into the hollow section more than that which will place the wires in the first position within the shaft. Wires move while anchored in the first plug in a direction to spread out from one another to permit the plastic sleeve to pass about the midpoint of the ball when the wires are pressed against the ball and then to contract about the ball after the plastic sleeves have passed the midpoint of the ball to enable the wires and sleeves to grasp and hole the ball

17 Claims, 2 Drawing Sheets

GOLF BALL RETRIEVAL APPARATUS

This application claims the benefit of Provisional application Ser. No. 60/285,694, filed Apr. 23, 2001.

BACKGROUND

1. Field

The present invention relates to the retrieval of athletic balls and more particularly to the retrieval of a single golf ball without the need for the player to bend over to retrieve the ball.

2. Prior Art

The usual way in which a golf ball is picked up is the golf player simply bends over and picks the ball up. As more people take up golf, this seemingly simple act can become a problem because with handicapped or elderly players there is a significant percentage with back problems stemming from injuries and arthritis, making the act of bending to retrieve a ball difficult.

SUMMARY

The present invention is a device built into the handle of a golf club, such as a putter, for picking up golf balls without the need to bend over to retrieve the ball. The handle of the club includes an opening at its upper end which houses up to 12 wires with plastic sleeves on the outward extending end of each wire. The wires are approximately 4 to 6 inches long and are positioned with their sleeved ends extending outwardly of the club handle. The lower ends of the wires are connected to a plug within the handle and are prevented from being totally withdrawn from the handle; however, they may be pulled out of the club handle approximately 4 inches and when withdrawn from the club they form a cone shaped array. The open end of the array extends away from the club handle and has a opening that is slightly smaller that a golf ball. By pressing down on a ball with the open end of the array, the wires expand to accept the ball and the ball becomes captured behind the sleeves and between the wires, thereby facilitating the lifting of the ball from the ground.

Typically during the pick up operation, the club is inverted and the handle is pointing downward. The ball is captured and the club is brought right side up to present the ball to the player, totally eliminating the need for the player to bend for the pick up operation. After retrieving the ball, the wires are retracted into the handle by pushing them down and inside the handle, leaving only a small portion of the sleeved ends of the wires extending out of the handle so that they may be grasped and pulled out again when needed. A small cap is placed over the sleeved ends of the retracted wires masking the wires completely and making the club virtually indistinguishable from a standard golf club.

DETAILED DESCRIPTION OF THE INVENTION

Figure 1:
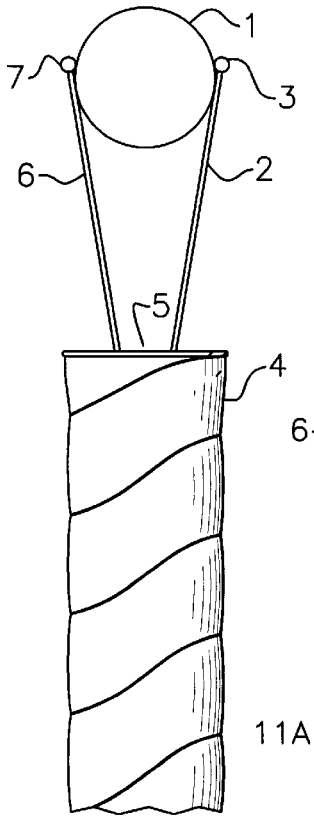
FIG. 1 shows the present invention extending from a club handle and gripping a golf ball.
Figure 7:
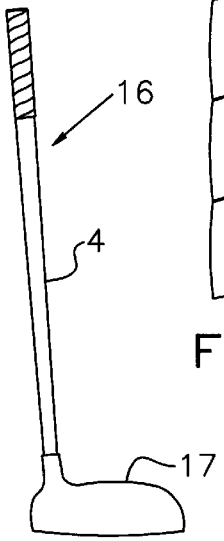
FIG. 7 shows a complete golf club with a handle attached to the club head.

FIG. 7 shows a standard golf club 16 comprising a handle 4 and a club head 17. Golf club handles are typically hollow metal shafts with the hollow portion extending longitudinally throughout the length of the shaft. The present invention is typically housed in the hollow upper end of the handle 4. FIG. 1 shows the present invention extending from the upper end of the handle to hold a golf ball 1 The upper end of the club handle 4 typically holds twelve wires of which two representative wires, 2 and 6, are shown extending outwardly of the handle where they are positioned to hold a golf ball 1. The ends of the wires include a sleeve such as sleeves 3 and 7 on wires 2 and 6 respectively. The sleeves, which are made of synthetic rubber to grip the ball and the wire, helps to prevent the ball from escaping from the grasp of the wires once the sleeves have passed over the middle of the ball. The wires such as 2 and 6 are spread apart at their ends to accept the ball. The up to 12 sires are positioned to form a conical array when extended from the handle. The open end of the conical array is positioned away from the upper end of the handle and is used to surround a ball.

Figure 5:
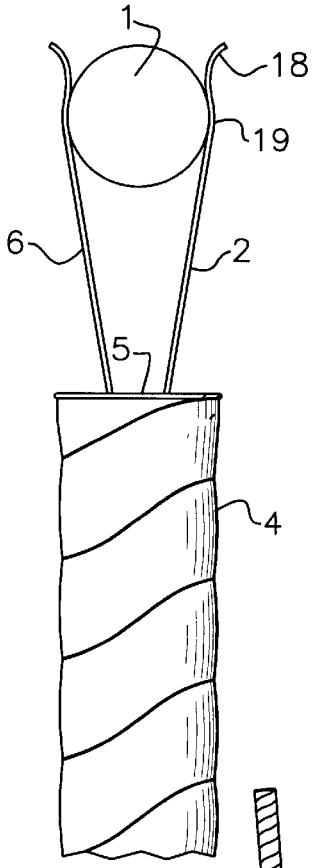
FIG. 5 shows a variation of the present invention which eliminates the need for sleeves by providing an "S" shaped contour at the ends of the wires.

An alternative configuration of the wire ends which eliminates the need for the sleeves is shown in FIG. 5. This Figure is identical to that of FIG. 1 except for the replacement of the sleeves with "S" shaped ends of the wires which serve the same function as the sleeves, but at lower cost. The "S" shaped wire ends include a flared out portion 18 and an immediately adjacent portion of the wires 19 which follows the contours of the golf balls. The flared out portion spreads apart when the wires are first pressed against the ball. The portion 19, which follows the contours of the ball then grips the ball, holding it until released by the player. The sleeves can be added to this configuration to aid in gripping the ball.

Figure 2:
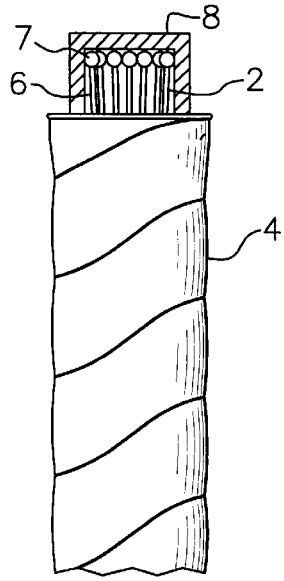
FIG. 2 shows the present invention stored in a club handle with a cap covering the ends of the wires and the sleeves.
Figure 6:
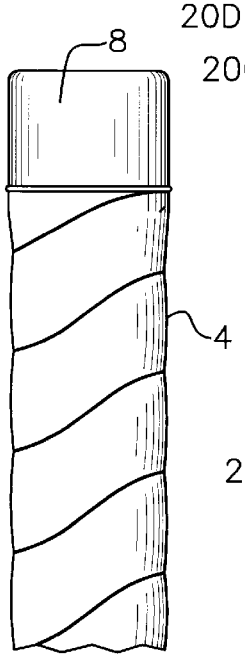
FIG. 6 shows the end of a handle with a cap covering the sleeved ends of the wires, masking the wires completely and making a club incorporating the present invention indistinguishable from a standard golf club.

The wires are constrained at one end so that, as they are pulled out by hand for use, they cannot be pull out from the end of the club more than a specified length such as 4 to 5 inches. FIG. 1 shows a typical set of fully extended wires. The wires are connected to a first plug 9 within the club handle that prevents them from spreading apart any more than is necessary for their sleeved ends to accept and grasp a golf ball When the pick up feature of the invention is no longer required, the wires are stored within the handle of the club in an opening 5 at the end of the club, as shown in FIG. 1. A typical storage position for the wires is shown in FIG. 2. The wires are pushed down into opening 5 until they hit a stop inside the handle which leaves about ½ inch of the wires extending out of the club. This is sufficient for gripping the ends of the wire when it is desired to again withdraw the wires outwardly of the club handle for the next ball pick up. A cap 8 is placed over the ends of the wires to make a neat package, within which the invention disappears out of view when not in use. The cap is held in place by the pressure exerted upon it from the sleeves. The cap also provides protection for the wire. An alternative version of the cap 8 is shown in FIG. 6. In this Figure the cap is closely fitted over the outside of the handle rather than about the sleeves.

Figure 3:
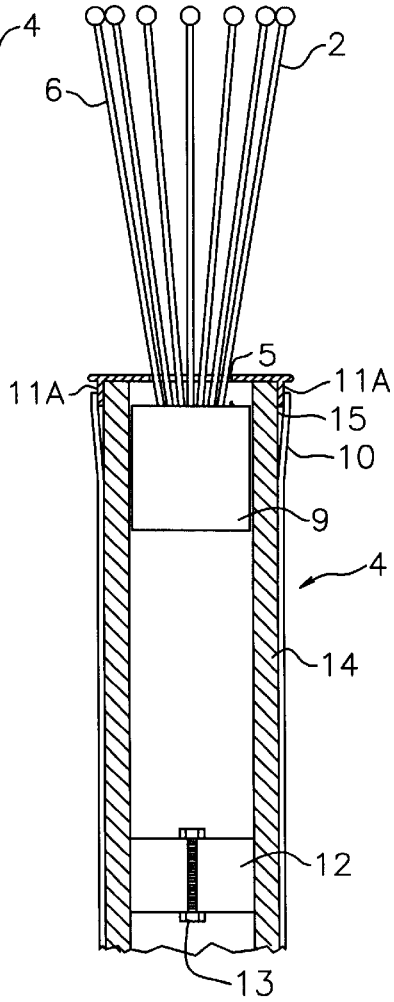
FIG. 3 is a cross sectional view of the present invention with the wires extended outwardly of the club.
Figure 4:
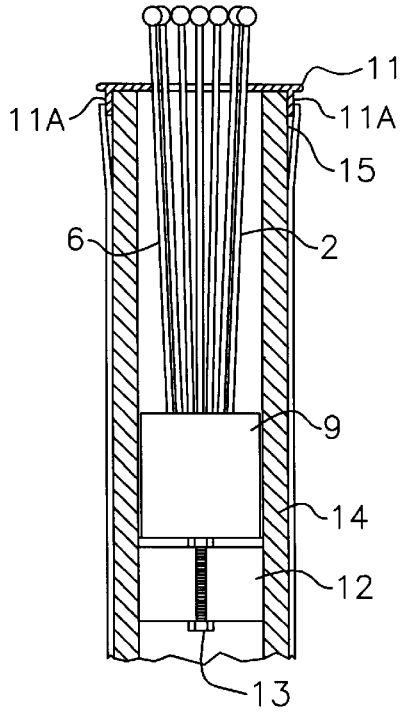
FIG. 4 is a cross sectional view of the present invention with the wires stored within the club.

The details of the operation of the present invention are shown in the cross sectional views of FIGS. 3 and 4. FIG. 3 shows the wires extended outwardly of the club, while FIG. 4 shows the wires stored within the club. The same drawing numerals used in FIG. 1 and FIG. 2 are again used for like members in FIGS. 3 and 4.

The additional components that can now be seen in FIGS. 3 and 4 are a first plug 9 used for anchoring the wires, a grip 10, a second or bottom plug 12, a third or top plug 11 with a rim 11A, a nut and bolt 13 for the bottom plug, a golf shaft 14 and a transitional section 15.

In these Figures, it can be seen that the golf shaft 14 has a top plug 11 which extends across the top of the shaft and is secured to the top of the shaft by means of pressing a tight fitting rim 11A about the shaft. The rim 11A is a part of the plug 11 and extends downward from this plug and about the shaft 14 of the golf club. The top plug 11 contains the opening 5, which allows the wires such as wire 2 and 6 to extend through the opening to the outside. All the wires are anchored in the first or mounting plug 9 which is formed of a flexible material that allows the wires to be flexed in their mounting positions. When the wires are position to extend outside the club, as shown in FIG. 3, the plug 9 is raised to the top of the shaft and is in contact with the top plug 11 which stops the mounting plugs upward movement; however, as shown in FIG. 4, when the pins are pushed back in to the shaft, the mounting plug 9 drops down below the top plug and is stopped from traveling too far within the shaft by the bottom plug 12. The mounting plugs outside diameter is slightly less then that of the inside diameter of the shaft, to permit relatively free upward and downward movement within the shaft.

An equivalent alternative to the top plug 11 is a nylon split ring which is inserted inside the top of the grip and rests on top of the shaft immediately above the opening 5. The ring is compressed to fit within the grip and then released when in place on the shaft. The pressure between the grip and the split ring hold the ring in place.

The bottom plug 12 which is a cylinder that closely fits within the shaft and contains a nut and a bolt 13 that passes through the center of the plug. By tightening the nut and bolt about the bottom plug, this plug expands and presses against the shaft, holding the plug 12 in position within the shaft. As the wires are pushed downward to store them within the top of the club, they are compressed by the opening 5 to allow them to fit within the opening. The flexibility of the mounting plug 9 accommodates the movement of the wires as they are pushed down into the top end of the club handle. This mounting plug, which is typically a cylinder made of synthetic rubber, also allows the wires to flex as necessary when a ball is accepted between the wires. The arrangement shown in FIGS. 3 and 4 has been constructed and tested in the field. It functions well and provides an excellent appearance when stored.

The clubs appearance is enhanced by the fact that the grip 10 which is typically wound about the outside of a club is continued up and wraps around the bottom edge of the rim portion 11A of the plug 11. The transition section 15, which is typically made of a relatively thick tapered plastic ribbon that wraps around the club shaft, provides a smooth taper from the rim to the shaft. Once the wires are stored within the shaft and the cap 8 has been placed over the wires, there is little to indicate the presence of the retrieval device. The appearance is virtually the same as that of a standard golf club. This completes the description of what is referred to herein as the standard version of the invention.

Figure 8:
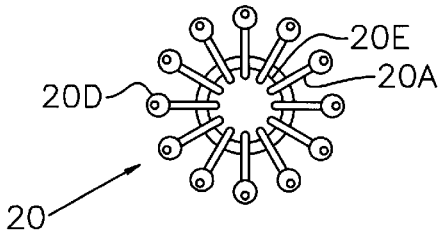
FIG. 8 shows an end view of an all plastic alternative model of the invention.
Figure 9:
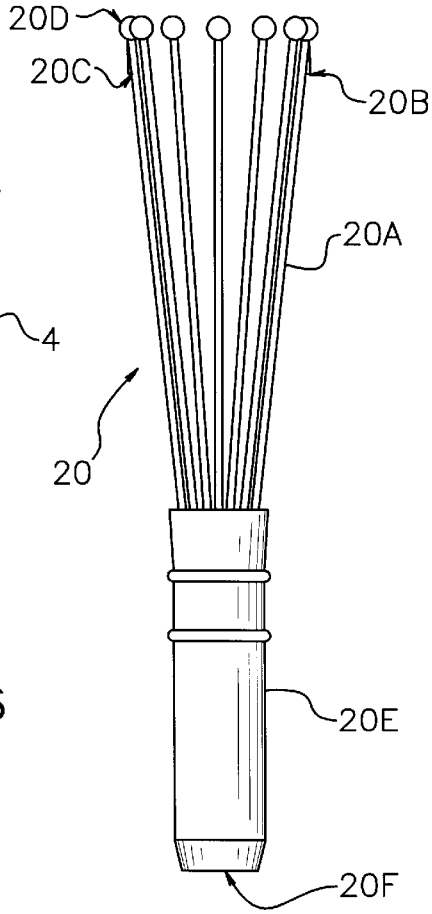
FIG. 9 shows a side view of an all plastic alternative model of the invention.

FIGS. 8 and 9 show an alternative version of the present invention referred as the all plastic version. Both Figures use the same drawing numerals to refer to the same elements. In the all plastic version, all the main parts are formed simultaneously by using a molding process on a plastic or other suitable material, such as DuPont's Acetol Dalrin 500. The parts formed in this way include the first plug, the wires and the sleeves. It is understood that the resulting "wires" and "sleeves" are now formed of a plastic or other nonmetalic material suitable for molding. This method of fabrication saves substantially on the cost of labor and material. In addition, the need for the second plug is eliminated, making further savings in fabrication possible.

FIG. 8 shows an end view of the all plastic version, while FIG. 9 shows a side view of this version. In FIG. 9 it can be seen that the all plastic version 20 comprises, a plastic first plug 20E used to mount one end of the plastic wires, a plurality of plastic wires, such as wire 20A, plastic sleeves, such as sleeve 20D, a shoulder in the plastic wires such as 20B and 20C, produced by the bottom of the sleeve and a tapered 20F on the bottom of the first plug 20E.

Alternatively, the sleeves may be made of synthetic rubber or other suitable flexible material and may be slipped over the end of the plastic wires. The surface of the sleeves may be roughened to provide better gripping of the ball and the sleeves may be bonded to the wires to provide a more secure hold on the wires. The top of the sleeves may include a cross piece to form a cap which limits the travel of the sleeves downward on the wires and insures the sleeves remain in the desired position on the upper ends of the wires.

The function and appearance of the all plastic version is similar to that of the standard version described above. The wires are anchored at one end in the first plug and extend outwardly from this plug in a conical array, as can bee seen in FIG. 8. Each wire terminates in a sleeve at its end that is away from the first plug. The plastic wires and sleeves are used to pick up a ball in the same way as the standard version.

In the assembly of the all plastic version the first plug 20E is inserted into the hollow end of the plug as was the first plug in the standard version. The first plug 20E in the all plastic version has a taper 20F which aids in inserting the plug into the shaft of the club. However, with the all plastic version, there is no need for the second plug to act as a stop to prevent the first plug from descending too far into the club. In the all plastic version, the shoulders, such as 20B and 20C formed by the sleeves in the wires catch the edge of the club opening preventing the top plug from descending too far into the club.

It is readily apparent that the components of the present invention may be fabricated from a variety of materials or combinations of materials such as metal sleeves with plastic wires or metal wires with plastic sleeves, depending on the ease of fabrication for a particular manufacturer or for a special preference dictated by other reasons. Such minor variations are considered within the scope of the present invention.

With respect to the above description then, it is to be realized that optimum dimensional relationships for the parts of the invention, to include variations in size, materials, shape, form, function and manner of operation, assembly and use, are deemed readily apparent and obvious to those skilled in the art, and all equivalent to those illustrated in the drawings and described in the specification are intended to be encompassed by the present invention.

Therefore, the foregoing is considered as illustrative only of the principals of invention. Further, since numerous modifications and changes will readily occur to those skilled in the art, it is not desired to limit the invention to the exact construction and operation shown and described, and accordingly, all such suitable modifications and equivalent that may be resorted to are considered as falling within the scope of the invention.

Having described my invention, I claim:

1. A ball retrieval apparatus, comprising:

(a) a shaft having a longitudinal axis, a first and a second end, a hollow portion at least at said second end of said shaft, said hollow portion extending longitudinally within said shaft, said shaft having an opening at said second end of the shaft which opens into said hollow of said shaft, (b) a first plug being located in said hollow portion of said second end of said shaft and being dimensioned to enable said first plug to be inserted through said opening into said shaft and into said hollow portion, said first plug being capable of moving longitudinally within said hollow portion of said shaft, (c) a plurality of wires of generally equal length, wherein the plurality is greater than 4, all of which have a first and a second end with said first end being anchored in said first plug and the second end extending outwardly of said shaft through said opening in said shaft, said wires being capable of moving longitudinally within said hollow portion of said shaft to a first and a second position, said first position exposing said wires outside of said second end of said shaft less than fifty percent of their length, and said second position exposing said wires outside said second end of said shaft more than fifty percent of their length, said wires in said second position being capable of being extended sufficiently out of said shaft to enable them to be pressed over and around a ball to grip said ball and pick up said ball by lifting said shaft, (d) a second plug, said second plug being fixedly located in said hollow portion of said second end of said shaft at a distance from the opening in said second end to prevent said first plug and wires from penetrating into said hollow portion more than that which will place said wires in said first position within said second end of said shaft, and (e) a plurality of hollow sleeves, each of said wires having one of said sleeves attached to its second ends, each sleeve being attached to a wire by sliding it over the second end of said wires.

2. Apparatus as claimed in claim 1 wherein said shaft forms a handle of a golf club, said club further comprising a club head, said club head being connected to the shaft at the first end of said shaft.

3. Apparatus as claimed in claim 2, wherein, said first plug is fabricated with a plurality of holes on a side facing the opening in the said handle when said first plug is placed in said hollow portion of said handle, said wires being anchored in said first plug by inserting the first ends of said wires in said holes in said first plug.

4. Apparatus as claimed in claim 3, wherein said wires each have a longitudinal axis, and said first plug is formed of a flexible material enabling said wires to be moved against the constraining force of said first plug in a direction generally orthogonal to their longitudinal axes while said wires remain anchored in said first plug.

5. Apparatus as claimed in claim 4 wherein said first plug is formed of rubber.

6. Apparatus as claimed in claim 5, wherein said wires move while anchored in said first plug in a direction to spread out from one another to permit said sleeves to pass about the midpoint of said ball when said wires are pressed against said ball and then permit said wires to contract about said ball after said sleeves have passed said midpoint of said ball to enable said wires and sleeves to grasp and hold said ball.

7. Apparatus as claimed in claim 4 wherein said holes in said first plug are arranged in a generally circular pattern and aligned to place said wires in a generally conical array when extended outside said handle to enable said wires to contact and surround said ball.

8. Apparatus as claimed in claim 7, further comprising a second plug, said second plug being fixedly located in said hollow portion of said handle at a distance from said opening in said handle to prevent said first plug and wires from penetrating into said hollow section more than that which will place said wires in said first position within said handle.

9. Apparatus as claimed in claim 8 further comprising a third plug, said third plug being fixedly positioned in said hollow section of said handle adjacent said opening in said handle, said third plug having a hole through it centered about the longitudinal axis of said handle, said hole in said third plug being sufficiently large to pass all the wires anchored in said first plug to permit said wires to extend outside said handle, said hole in said third plug being sufficiently small to block said first plug and prevent said first plug and said wires anchored in said first plug from moving completely out of said handle, and said third plug being positioned to stop said wires and first plug in said second position of said wires.

10. Apparatus as claimed in claim 7 further comprising a first cap, said first cap having a size which closely fits over the exposed portion of said wires when said wires are in their first position, said first cap being closely fitted about said wires and held in its position over said wires by the pressure exerted by said wires on said first cap, said first cap completely covering the exposed portion of said wires outside said handle to mask the presence of said wires.

11. Apparatus as claimed in claim 7, further comprising a cap, said cap fitting closely over the second end of said handle and completely covering the exposed portion of said wires when they are placed in their first position, said cap fitting closely over the second end of said handle and being held in its position on the handle by the pressure between the handle and said cap derived from the close fitting of said cap over the handle.

12. A ball retrieval apparatus as claimed in claim 1, further comprising a sleeve on each wire at its end that is away from said first plug, and wherein said first plug said wires and said sleeves are all formed simultaneously as one piece by a molding process.

13. A ball retrieval apparatus as claimed in claim 12 wherein said first plug, said wires and said sleeves are formed of a plastic material.

14. A ball retrieval apparatus as claimed in claim 13 wherein said plastic material is Acetol Dalrin 500.

15. Apparatus as claimed in claim 1, wherein said sleeves are further attached by means of a bonding agent placed between the sleeves and the wires.

16. Apparatus as claimed in claim 1, wherein said sleeves have caps on one end to set their position on the ends of said wires.

17. A golf ball retrieval apparatus comprising, (a) a putter type of golf club, said putter type of golf club having a club head and a handle, said handle having a first and a second end with said handle being attached at its first end to said club head, said handle having a hollow portion which extends longitudinally within said handle from its second end and said handle having an opening through its second end to said hollow portion within said handle, (b) a first plug being dimensioned to permit insertion through said opening in said handle and movement longitudinally within said hollow portion of said handle, said first plug being made of a flexible rubber and containing a plurality of holes on a side which faces said opening in said handle when said plug is positioned within said hollow portion of said handle, (c) a plurality of wires of generally equal length which is typically 4 to 6 inches, each wire having a first and a second end with the first end being anchored in one of said holes in said first plug, said wires being capable of being placed in a first position with the tips of said wires at their second ends extending a percentage of their length, which is less than 50 percent of their length, and more typically 10 percent or approximately one half inch, out of said hollow portion of said handle through said opening in said handle and also in a second position where more than 50 percent, and more typically 90 percent of their length is extended through said opening in the second end of said handle, said wires being moved manually from said first to said second position, said wires in said second position being oriented in said first plug to form a conical array with the second ends of said wires being spaced diametrically apart a distance generally equal to the diameter of a golf ball, (d) a plurality of sleeves, each sleeve being placed over and attached to the second end of each wire, said sleeves being forced over a golf ball when said wires are in their second position to grip and hold said golf ball between said wires and said sleeves, (e) a second plug referred to as the bottom plug being secured in said hollow portion of said handle at a distance from said opening in said handle which will prevent said first plug and said wires from penetrating said hollow portion more than that which will place said wires in said first position, (f) a third plug having a hole through its center to permit all of said wires to pass through said hole in said third plug, said third plug being secured in said hollow portion of said handle adjacent said opening in said handle at a distance which will prevent said first plug and said wires from being drawn towards said opening in said handle more than said second position of said wires, and (g) a cap having a size capable of fitting over said wires and said sleeves when said wires are in said first position to cover said wires and grip the second end of said wires to hold said cap in its position over said wires.

* * * * *